US005544814A

United States Patent [19]

Spenser

[11] Patent Number: 5,544,814

[45] Date of Patent: Aug. 13, 1996

[54] ROTARY SPRINKLERS

[75] Inventor: Benjamin Spenser, Zichron-Jaacob, Israel

[73] Assignee: Dan Mamtirim, Israeli Limited Partnership, Galil Elion, Israel

[21] Appl. No.: 264,516

[22] Filed: Jun. 23, 1994

[30] Foreign Application Priority Data

Jun. 25, 1993 [IL] Israel ..... 106138

[51] Int. Cl.[6] ..... B05B 3/04

[52] U.S. Cl. ..... 239/241; 239/222.11; 239/246

[58] Field of Search ..... 239/237, 240, 239/246, 231, DIG. 1, 206, 222.11, 222.17, 214, 251, 241

[56] References Cited

U.S. PATENT DOCUMENTS

| | | | |
|---|---|---|---|
| 1,811,171 | 6/1931 | Buckner | 239/231 |
| 2,009,478 | 7/1935 | Coles et al. | 239/241 |
| 2,052,673 | 7/1935 | Stanton | 239/67 |
| 2,310,796 | 2/1943 | Lappin | 239/231 |
| 2,393,091 | 1/1946 | Lacy-Mulhall | 239/206 |
| 3,266,737 | 8/1966 | Nees | 239/596 |
| 3,272,437 | 9/1966 | Coson | 239/240 |
| 3,408,009 | 10/1968 | Friedmann et al. | 239/231 |
| 4,205,787 | 6/1980 | Bruninga | 239/230 |
| 4,407,455 | 10/1983 | Sargent | 239/222.17 |
| 4,796,810 | 1/1989 | Zakai | 239/222.17 |
| 5,007,586 | 4/1991 | Cohen | 239/222.17 |
| 5,058,806 | 10/1991 | Rupar | 239/206 |
| 5,123,597 | 6/1992 | Bendall | 239/206 |
| 5,172,864 | 12/1992 | Spencer | 239/241 |
| 5,224,653 | 7/1993 | Nelson et al. | 239/222.17 |
| 5,232,157 | 8/1993 | Laffrey | 239/222.17 |
| 5,297,737 | 3/1994 | Davisson | 239/222.17 |
| 5,299,742 | 4/1994 | Han | 239/DIG. 1 |
| 5,372,307 | 12/1994 | Sesser | 239/231 |
| 5,375,768 | 12/1995 | Clark | 239/240 |

*Primary Examiner*—Andres Kashnikow
*Assistant Examiner*—Lisa Douglas
*Attorney, Agent, or Firm*—Browdy and Neimark

[57] ABSTRACT

A rotatable outlet nozzle for use in a rotary sprinkler adapted to be rotatably mounted and driven in a sprinkler housing and comprising a through-flow tube portion, a curved deflector wall portion merging with an outlet end of the tube and defining a main outlet and an auxiliary outlet formed in the deflecting wall in a position thereof opposite the main outlet, the positioning and dimensions of the auxiliary outlet being such that an auxiliary water spray emerges therefrom in a direction opposite to that of a main water spray emerging from the main outlet.

7 Claims, 3 Drawing Sheets

ROTARY SPRINKLERS

FIELD OF THE INVENTION

The present invention is in the field of rotary sprinklers and more specifically it concerns a rotary sprinkler of the kind having a rotatable outlet nozzle.

BACKGROUND OF THE INVENTION

In the following description and claims rotatable outlet nozzles and rotors which at times are referred to as reaction swivels will be referred to collectively as "rotatable outlet nozzles".

Rotary sprinklers having a rotatable outlet nozzle have long been known. Such sprinklers typically fall into different categories depending among others on the means for rotating the outlet nozzle.

One category of such sprinklers comprise a housing with a water inlet and a water outlet nozzle adapted for rotating by a driving mechanism receiving its energy from the water inflow and successively transferring that energy to the rotatable outlet nozzle.

Such rotating driving mechanisms are known, for example, in U.S. Pat. No. 2,052,673 to Stanton, disclosing a rotary sprinkler motor in which a drive ball is displaced within a ball race into impacting engagement with an impeller element of the outlet nozzle, resulting in successive impacts, and a substantial continuous rotation of the nozzle. As a result there is emitted an essentially sharply defined water stream having a relatively large range.

Another type of such sprinklers, falling into a second category, typically comprise a rotor rotatably mounted with respect to an inlet portion formed with a through-flow tube. The rotor is provided with a deflecting surface adjusted to be impinged by a jet flowing axially from an outlet of said tube whereby, the jet is deflected laterally and the rotor is rotated. Such a sprinkler disclosed, for example, in U.S. Pat. No. 5,007,586 to Cohen.

It yet another type of rotary sprinklers, falling within a third category, are the hammer sprinklers in which both the rotary motion and the stream disruption are achieved by a hammer-impact mechanism.

It is known that the precipitation distribution of the water spray in rotary sprinklers is not homogenous along the radius of the spray and therefore does not fulfil irrigation requirements and attempts have been made to achieve substantially uniform irrigation within a given zone.

By the term "water precipitation" is meant the volume of water dispersed over a unit area during a unit of time. The water precipitation distribution is directly dependant on the square of a distance (R) from the sprinkler. Thus, in order to obtain an ideally uniform water distribution over a given area, means must be provided for compensating the regions nearer to the sprinkler.

The problem of non-homogenous water precipitation distribution becomes more severe when several sprinklers act jointly whereby overlapping zones of adjacent sprinklers (which naturally are remote from the sprinklers), will have an excessive water precipitation destination, where the zones near the sprinklers will have an inadequate distribution.

Various means have been proposed so to obtain an improved water precipitation distribution. For example, it is known to introduce discontinuities into the cross-section of the water outlet and in this way to disrupt the water spray.

One known method to achieve this was to insert an adjusting screw into the nozzle near its discharge outlet and adjusting as desired the rate of penetration of the screw into the water stream.

Another method which has been suggested for obtaining an improved water precipitation distribution is by providing additional outlet apertures which are of very small size as compared with that of the main outlet aperture and are located substantially on the same side of the nozzle as the main outlet aperture. These additional apertures are intended to provide short range water coverage. It has been found however that the small outlet apertures frequently clog.

With hammer-impact sprinklers, the disruption of the stream is achieved by the hammer-impact as well as by an additional aperture and optionally an adjusting screw. A disadvantage of such impact hammer-type sprinklers resides in the fact that they are of a relatively complicated construction and are, on the one hand, relatively expensive and, on the other hand, faulty operation of the sprinkler is likely to require periodic maintenance and servicing.

It will furthermore be realized that the problem of non-uniform precipitation distribution cannot be solved by arranging merely for an increased precipitation in the region of the sprinkler (say up to 2 meters therefrom) seeing that this will usually be at the expense of precipitation at greater ranges.

BRIEF DESCRIPTION OF THE INVENTION

It is an object of the present invention to provide a rotary sprinkler of the kinds specified in which the above-referred to disadvantages are substantially reduced or overcome.

According to the present invention there is provided a rotatable outlet nozzle for use in a rotary sprinkler adapted to be rotatably mounted and driven in a sprinkler housing and comprising a through-flow tube portion; a curved deflector wall portion merging with an outlet end of said tube and defining a main outlet and an auxiliary outlet formed in said deflecting wall in a position thereof opposite said main outlet, the positioning and dimensions of the auxiliary outlet being such that an auxiliary water spray emerges therefrom in a direction opposite to that of a main water spray emerging from said main outlet and wherein a discharge coefficient C of the outlet nozzle as hereinafter defined lies substantially in the range of 5 to 40.

As used in the present specification and claims, the discharge coefficient C of the outlet nozzle is the ratio of the quotient of the discharge rate $Q_n$ of the nozzle outlet and the discharge rate $Q_a$ of the auxiliary outlet to the quotient of the discharge area $A_n$ of the nozzle outlet and the discharge area $A_a$ of the auxiliary outlet, $$\text{i.e. } C=Q_n/Q_a/\ A_n/A_a$$

Said curved deflector wall portion may be formed integrally with the tube portion so as to be rotatably mounted together therewith in the sprinkler housing. Alternatively, the tube portion may be fixedly mounted or included within the sprinkler housing and the curved deflector wall portion rotatably mounted with respect thereto.

DESCRIPTION OF THE DRAWINGS

For a better understanding of the invention and to show how the same may be carried out in practice and by way of example reference will now be made to the accompanying drawings in which.

DESCRIPTION OF A SPECIFIC EMBODIMENT

Figure 2:
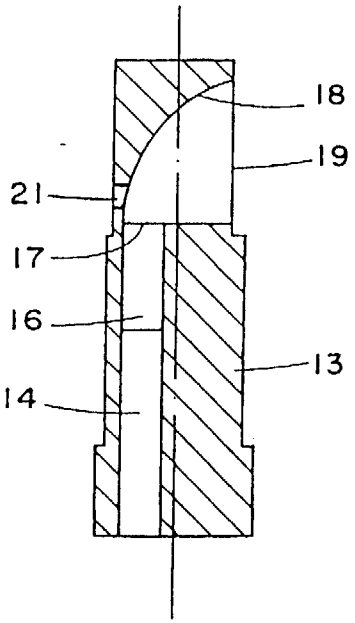
FIG. 2 is a longitudinally sectioned view of the outlet nozzle shown in FIG. 1 taken along the line II—II.
Figure 1:
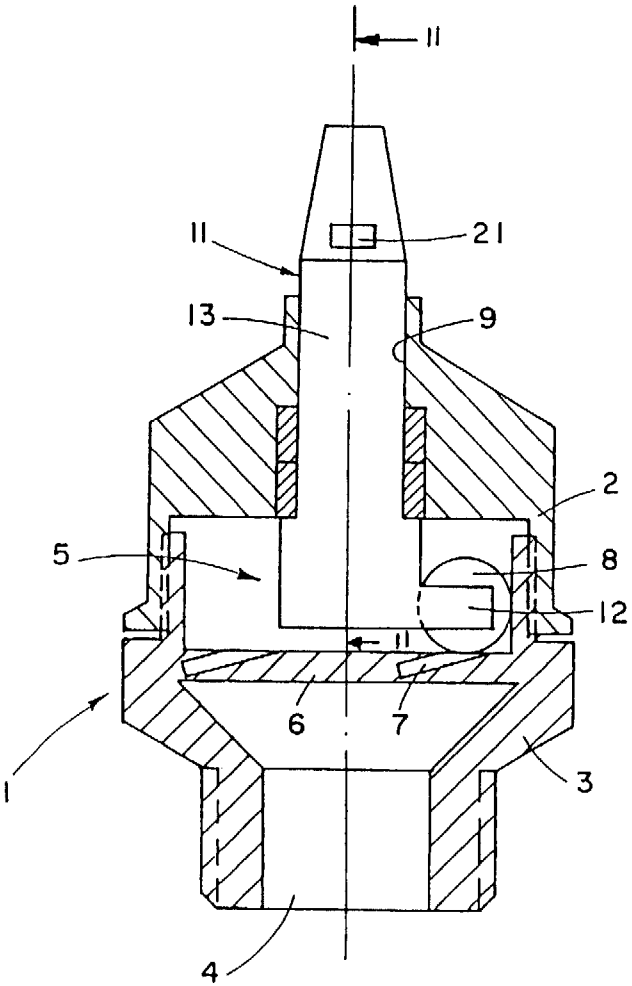
FIG. 1 is a longitudinally sectioned view of one form of rotary rotatable outlet nozzle in accordance with the present invention.

As seen in FIGS. 1 and 2 of the drawings the rotary sprinkler comprises a housing 1 consisting of an upper casing 2 screw coupled to a lower casing 3 formed with an integral water inlet 4 and a driving motor 5. The driving motor 5 comprises a planar base 6 having four tangentially directed, water inlet ports 7 and a steel drive ball 8 freely located within the motor 5 so as to roll on the base 8.

Rotatably mounted within an outlet opening 9 of the upper casing 2, is an elongated outlet nozzle 11 formed at its lower end with a laterally extending impeller element 12.

The outlet nozzle 11 is formed with a through-flow tube portion 13 having a through-flow tubular passage 14, its upper end 16 being of substantially elliptic cross-section. A nozzle outlet 17 of the upper end 16, is formed integrally with a curved deflecting wall portion 18 having a main outlet 19 and an auxiliary outlet 21 of a rectangular cross-section formed in the curved deflecting wall 18, opposite the main outlet 19 and above the outlet 17.

In operation, water flows into the sprinkler housing 1 through the water inlet 4 and into the driving motor 5 via the tangentially disposed water ports 7. In consequence, the drive ball 8 is rotatably displaced within the motor and it then impacts the laterally projecting impeller element 12 of the outlet nozzle 11, resulting in the rotational displacement of the impeller element 12 and the associated outlet nozzle 11. Most of the water flows out from the main outlet 19 and only a small amount of water flows from the auxiliary outlet 21, resulting in a full water coverage extending from the sprinkler itself to the maximum range of the sprinkler.

Figure 3:
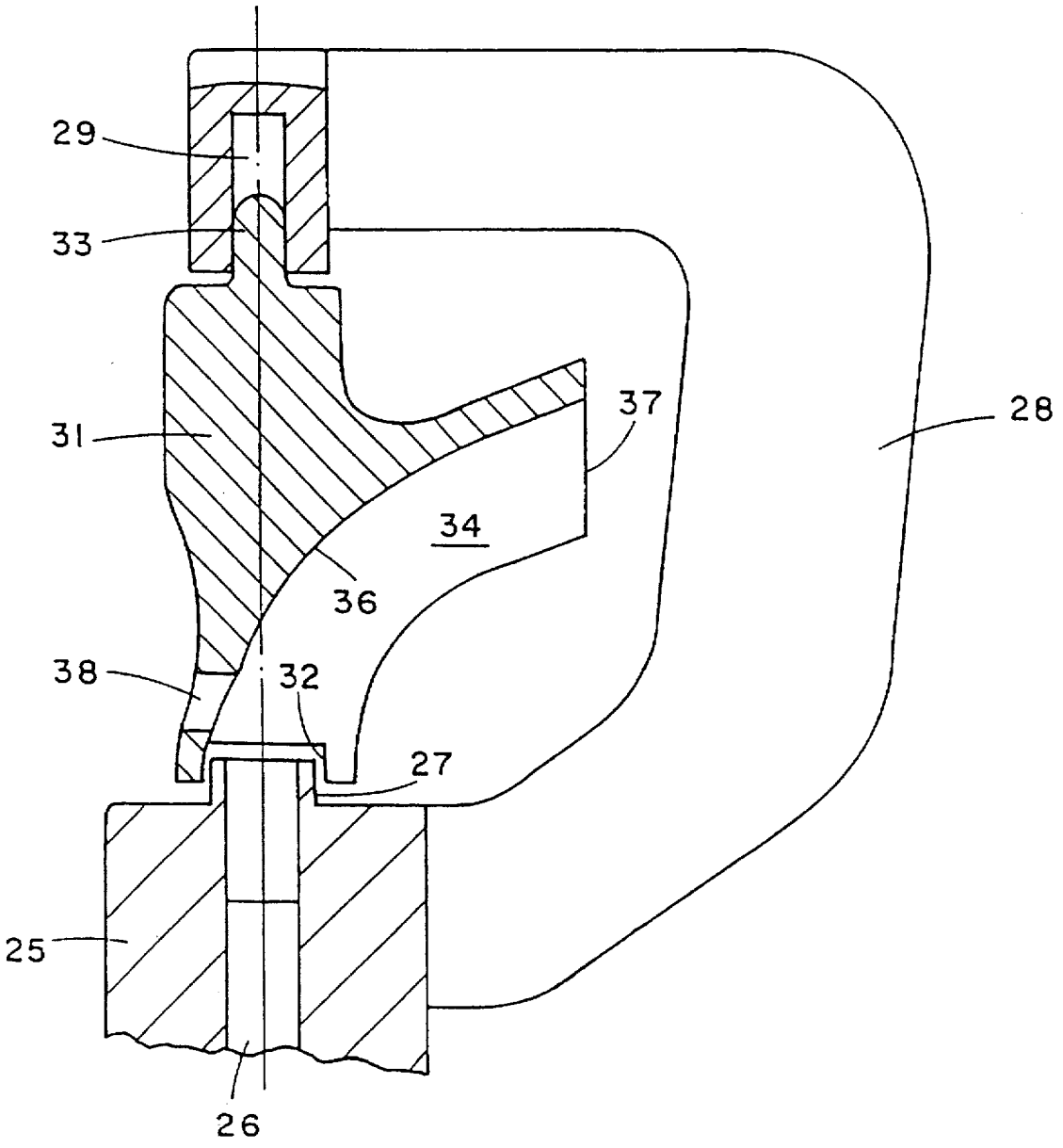
FIG. 3 is a longitudinally sectioned view of a further form of a rotatable outlet nozzle in accordance with the present invention.

In FIG. 3 of the drawings there is shown a rotary sprinkler in which an inlet member 25 has formed integrally therewith a through-flow tube 26 with an upward projecting nozzle outlet 27. A bridging member 28, integral at its lower end with the inlet member 25, is formed at its upper end with a socket 29.

A rotor 31 is formed at a lower end with a socket 32 in which is received the upward projecting nozzle outlet 27 and at its upper end with a locating pin 33 received within the socket, 29. The rotor 31 is formed with a curved deflecting wall portion 36 merging smoothly with the outlet nozzle 27 of the inlet member 25 and has defined therein a curved outlet path 34. The rotor 31 is provided with a main outlet 37 and at a rear portion of the curved deflecting wall 36 opposite said main outlet 37 and above the projecting outlet 27, there is formed an auxiliary outlet 38 of a rectangular cross-section.

The maximum range of such sprinklers depends on several parameters, e.g. water inlet pressure and the specific dimensions and geometry of the sprinkler and its outlet nozzle and the provision of the auxiliary outlets 21 and 38, in the rear deflecting walls 18 and 36 does not significantly affect their maximum range. On the other hand, the distribution of the water precipitation distribution is very significantly improved.

This improved water precipitation distribution was obtained with rotatable nozzles having a discharge coefficient as hereinbefore defined lying in the range of approximately 5 to 40. Preferably C should be in the range of 15 to 30.

Figure 4:
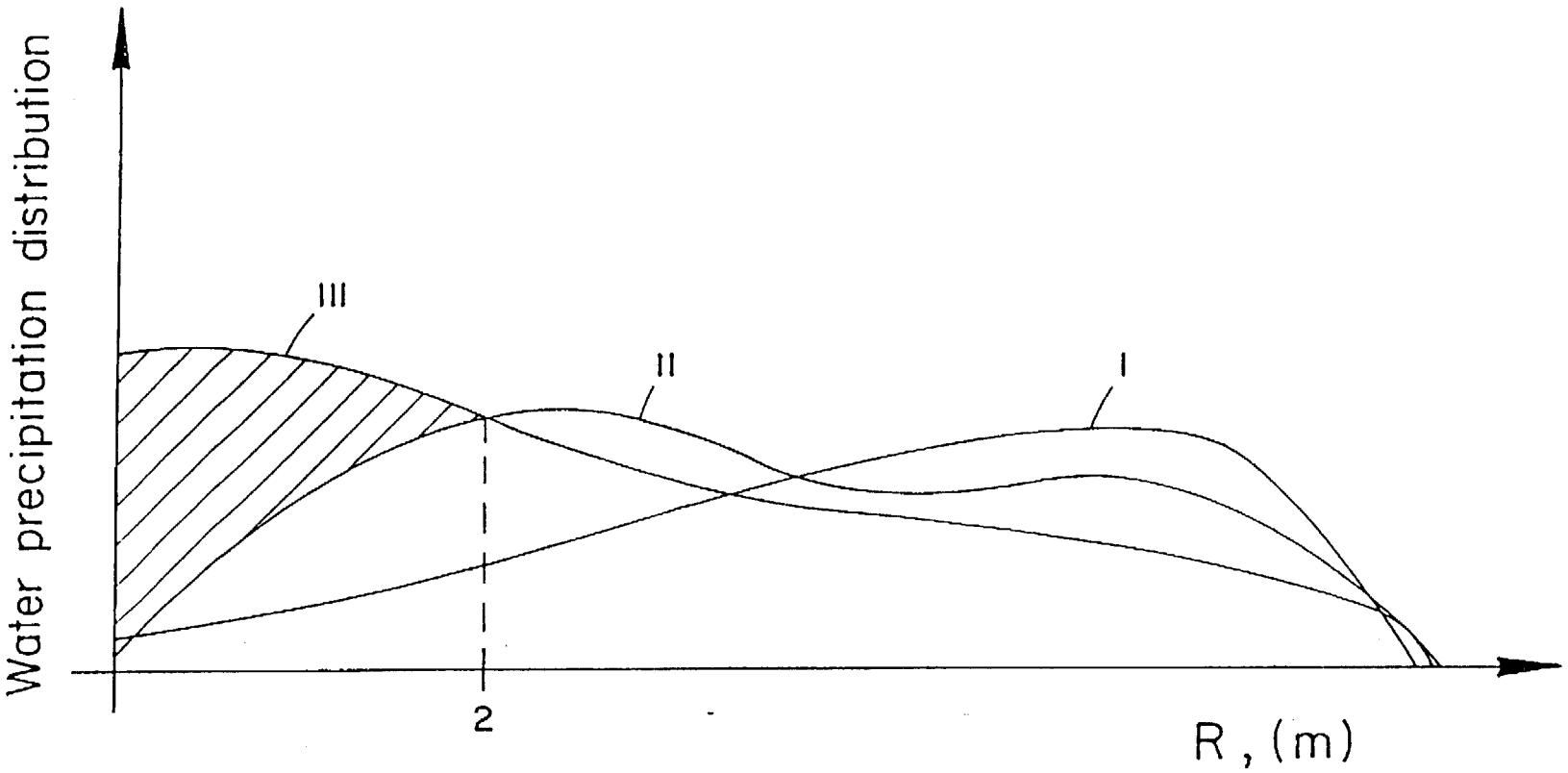
FIG. 4 shows various curves illustrating the variation of water precipitation distribution with spray range R, for different types of sprinkler outlet nozzles.

Referring to FIG. 4 of the drawings the variation of water distribution with range R is shown for various nozzles. Curve I shows this variation for a conventional nozzle. Curve II shows the variation with a nozzle in which discontinuities have been introduced in a known way in the water outlet and curve III shows the distribution variation with a nozzle in accordance with the present invention.

As seen with a conventional outlet nozzle (curve I) the zone near the sprinkler (up to R-approx. 2 meters) has a low water precipitation, whereas remote from the sprinkler, the water precipitation is essentially high. This undesired situation yields to under watering near the sprinkler and excessive watering remote from the sprinkler. When several sprinklers are positioned so as to obtain maximum coverage of a given area by overlapping between the adjacent sprinklers this situation is even more pronounced.

The various known attempts made to improve the distribution of the water have yielded a somewhat improved precipitation distribution as shown in curve II. In this case, there is an increase in water precipitation near the sprinkler but this increase is insufficient. Furthermore, there occur several fluctuations along the radius, yielding again in a non-homogenous overall sprinkling and remote from the sprinkler, at the overlapping zones there is excessive precipitation as with the conventional sprinkler.

Curve III, shows the water precipitation of a sprinkler with an outlet nozzle in accordance with the present invention. Here there is a significantly essential increased precipitation near the sprinkler with a gradual decrease towards the end of the sprinkling range of the sprinkler where overlapping takes place.

The increased water precipitation near the sprinkler is not accompanied by any significant reduction at more remote regions. The particular locations of the auxiliary outlets 21 and 38, and their size ensures a ratio of discharge rate of the main outlets 19 and 37, respectively, and the auxiliary outlets 21 and 38, respectively, of approximately 1 to 30. Thus, only a small amount of water emitted from the auxiliary outlet is sufficient in order to ensure achieving the desired change in the water precipitation due to the dependency of the precipitation on $R^2$.

In one specific embodiment, a rotary sprinkler as shown in FIGS. 1 and 2 had a discharge rate of 600 liters per hour and a range of 10 meters. The rectangular auxiliary outlet 21 had dimensions of 2×4 millimeters, and only 20 liters per hour were emitted therefrom, this amount being sufficient to obtain the improved water precipitation within a 2 meter range of the sprinkler.

It should be readily understood that whilst the outlet nozzles described above have been shown as forming part of only two specific forms of rotary sprinklers in accordance with the present invention, the construction of these outlet nozzles is capable of being used with other forms of rotary sprinklers.

Furthermore, it should be appreciated that the auxiliary outlet 21 and 38, respectively, may be of different shapes and dimensions, however in all cases the dimensions are large enough so as to avoid clogging.

I claim:

1. A rotatable outlet nozzle for use in a rotary sprinkler adapted to be rotatably mounted and driven in a sprinkler housing and comprising a through-flow tube portion; a curved deflector wall portion merging with an outlet end of said through-flow tube and defining a main outlet and an auxiliary outlet formed in said curved deflector wall in a position thereof opposite said main outlet, the positioning and dimensions of the auxiliary outlet being such that an auxiliary water spray emerges therefrom in a direction opposite to that of a main water spray emerging from said main outlet and wherein a discharge coefficient C, which is the ratio of (1) the quotient of the discharge rate of the main outlet and the discharge rate of the auxiliary outlet to (2) the quotient of the discharge area of the main outlet and the discharge area of the auxiliary outlet, lies substantially in the range of 5 to 40.

2. A rotatable outlet nozzle according to claim 1 wherein said range extends between 15 and 30.

3. A modification of the rotatable outlet nozzle according to claim 1, wherein said through-flow tube portion is integral with said sprinkler housing and wherein said curved deflector wall portion is rotatably mounted with respect thereto and extends smoothly from said outlet end of said through-flow tube portion.

4. A rotatable outlet nozzle according to claim 1, wherein the auxiliary outlet is substantially rectangular in shape.

5. A rotatable outlet nozzle according to claim 4, wherein said auxiliary outlet has dimensions of 2×4 mm.

6. A rotatable nozzle for use in a rotary sprinkler adapted to be rotatably mounted and driven in a sprinkler housing, comprising:

a through-flow tube portion having a nozzle outlet;

means for directing a major proportion of water in a first and principal direction comprising a curved deflector wall portion downstream of said nozzle outlet of said through-flow tube and defining a first discharge area;

means for passing a minor proportion of water in a direction opposite to that of the first and principal direction, comprising an auxiliary outlet formed in said curved deflector wall in a position opposite said first direction, and defining a second discharge area;

said rotatable outlet nozzle having a discharge coefficient C, which is the ratio of (1) the quotient of the discharge rate in said first direction and the discharge rate in the second direction to (2) the quotient of the first area and the second are, substantially within the range of 5–40.

7. A rotary water sprinkler comprising a first portion which is stationary in use and a second portion which is rotatable relative to said first portion, said first and second portions having cooperating water through-flow passages extending therethrough and a nozzle outlet from which water passes from a relatively small cross-section to a relatively large cross-section;

means for directing a major proportion of water in a first and principal direction comprising a curved deflector wall portion downstream of said nozzle outlet and defining a first discharge area;

means for passing a minor proportion of water in a direction opposite to that of the first and principal direction, comprising an auxiliary outlet formed in said curved deflector wall in a position opposite said first direction, and defining a second discharge area;

said rotary water sprinkler having a discharge coefficient C, which is the ratio of (1) the quotient of the discharge rate in said first direction and the discharge rate in the second direction to (2) the quotient of the first area and the second area, substantially within the range of 5–40.

* * * * *